United States Patent [19]

Ramer

[11] 4,367,885

[45] Jan. 11, 1983

[54] SKI BINDING

[75] Inventor: Paul C. Ramer, Golden, Colo.

[73] Assignee: Alpine Research, Inc., Golden, Colo.

[21] Appl. No.: 139,252

[22] Filed: Apr. 11, 1980

[51] Int. Cl.[3] ..... A63C 9/08

[52] U.S. Cl. ..... 280/614; 36/121; 280/618

[58] Field of Search ..... 280/614, 618, 617, 611, 280/613; 36/121, 120, 119, 118, 117

[56] References Cited

U.S. PATENT DOCUMENTS

| | | | |
|---|---|---|---|
| 3,619,914 | 11/1971 | Hanson et al. | 36/121 |
| 3,870,325 | 3/1975 | Davis | 280/611 |
| 3,945,134 | 3/1976 | Ramer | 36/121 |
| 3,964,756 | 6/1976 | Mory | 280/614 |
| 4,002,354 | 1/1977 | Ramer | 280/614 |
| 4,058,326 | 11/1977 | Faulin | 280/617 |

FOREIGN PATENT DOCUMENTS

| | | | |
|---|---|---|---|
| 2057094 | 5/1973 | Fed. Rep. of Germany | 36/121 |

*Primary Examiner*—Joseph F. Peters, Jr.
*Assistant Examiner*—Milton L. Smith
*Attorney, Agent, or Firm*—Gary M. Polumbus

[57] ABSTRACT

A ski binding for use both in downhill skiing and cross-country skiing which can be used with either conventional downhill skiing boots or with non-skiing boots through the use of a leg cast which conformably grasps the lower leg of a skier. The leg cast is selectively pivotal relative to a boot plate for cross-country skiing, and vertically releasable from the ski during downhill or cross-country skiing.

20 Claims, 8 Drawing Figures

SKI BINDING

BACKGROUND OF THE INVENTION

1. Field of Invention

This invention relates to ski equipment and more particularly to a snow-ski binding adapted for convertible use in both downhill and cross-country skiing. The ski binding is of a type that can be used without a conventional downhill skiing boot.

2. Description of the Prior Art

There are two general types of snow-skiing, alpine or downhill skiing and Nordic or cross-country skiing. The requirements of ski bindings for binding the skier's boot to the ski are different for alpine skiing than for cross-country skiing, and it is typical that a binding used for downhill skiing is not usable for cross-country skiing. Specific footwear, in the form of rigid boots, have previously been required for alpine skiing. Neither the binding used nor the boot used in alpine skiing is directly applicable to cross-country skiing, since cross-country skiing requires a pivoting of the skier's foot near the toe while alpine skiing requires the boot to be firmly, but preferably releasably connected to the ski. Ski equipment has been developed for use in both downhill and cross-country skiing as evidenced by U.S. Pat. Nos. 3,945,134, 4,002,354 and 4,157,191 which are of common ownership with the present invention, and the present invention relates to improvements in equipment of the type described in the aforenoted patents.

Several prior art ski bindings have been adapted to transmit force from the lower leg of a skier to the ski. Examples of such bindings are disclosed in U.S. Pat. Nos. 3,747,235 to Post; 4,021,053 to Willi; and 4,058,326 to Faulin. Of those patented bindings, only the Faulin binding can be utilized with more or less conventional footwear having relatively pliant characteristics. The prior art does not show a binding that can be used with conventional shoes or hiking boots that additionally allows a user to both downhill and cross-country ski, using the same equipment.

SUMMARY AND OBJECTS OF THE INVENTION

It is accordingly the principal object of the present invention to provide a new and improved binding adapted for use in both downhill and cross-country skiing.

It is a further object of the present invention to provide a new and improved binding for a ski which will allow the use of conventional footwear by a skier.

It is another object of the present invention to provide a new and improved ski binding for use in cross-country skiing and downhill skiing wherein the foot of a skier can pivot about the ball of his foot when cross-country skiing.

It is another object of the present invention to provide a new and improved ski binding for downhill skiing wherein the lower leg of the skier can be used to effectively transmit force to the ski itself.

The ski binding of the present invention includes a boot plate which is selectively securable to the bottom of a skier's footwear by means of a leg cast which is adapted to conformably wrap around the lower leg of a skier and hingeably mounted to the boot plate. Toe and heel pieces are securely mountable on a ski to releasably retain the boot plate on the ski for downhill skiing. In downhill skiing a strut is connected between the leg cast and the boot plate to prevent relative pivotal movement therebetween, while in cross-country skiing the strut is removed from the ski binding or released from the boot plate and rotated to a stored position on the leg cast. The leg cast is allowed to pivot relative to the boot plate once the strut is disconnected from the boot plate, which permits a skier to apply cross-country skiing movements.

The leg cast is of two piece construction including a rear portion which is pivotally connected to the boot plate. The leg cast has a front portion which wraps around the skier's leg and is latched to the rear portion of the leg cast. The strut interconnects the rear portion to the rear of the boot plate. The strut is selectively removable to the stored position from its connection at the heel of the boot plate.

The boot plate includes a carriage body having on opposite sides thereof a pair of semi-rigid spring bars which protrude forwardly from a central portion of the carriage body of the boot plate. The spring bars receive laterally extending pins mounted on the toe piece. The pins fit into the spring bars in such a manner that the boot plate and spring bars pivot about the pins for cross-country skiing. In downhill skiing the spring bars will release from the pins upon a predetermined amount of force being applied to the boot plate.

The heel piece has a beveled surface adapted to cooperate with a mating beveled surface on a heel end cap member of the boot plate to hold the rearward end of the boot plate immediately adjacent to the ski when the binding is being used for downhill skiing. The heel piece can be released to rotate about a vertical axis perpendicular to the ski to release the heel of the boot plate and allow for pivoting of the boot plate about the toe piece pins for cross-country skiing.

BRIEF DESCRIPTION OF THE DRAWINGS

FIG. 7 is a perspective view of the heel piece of the snow ski binding.

DESCRIPTION OF THE PREFERRED EMBODIMENTS

Figure 1:
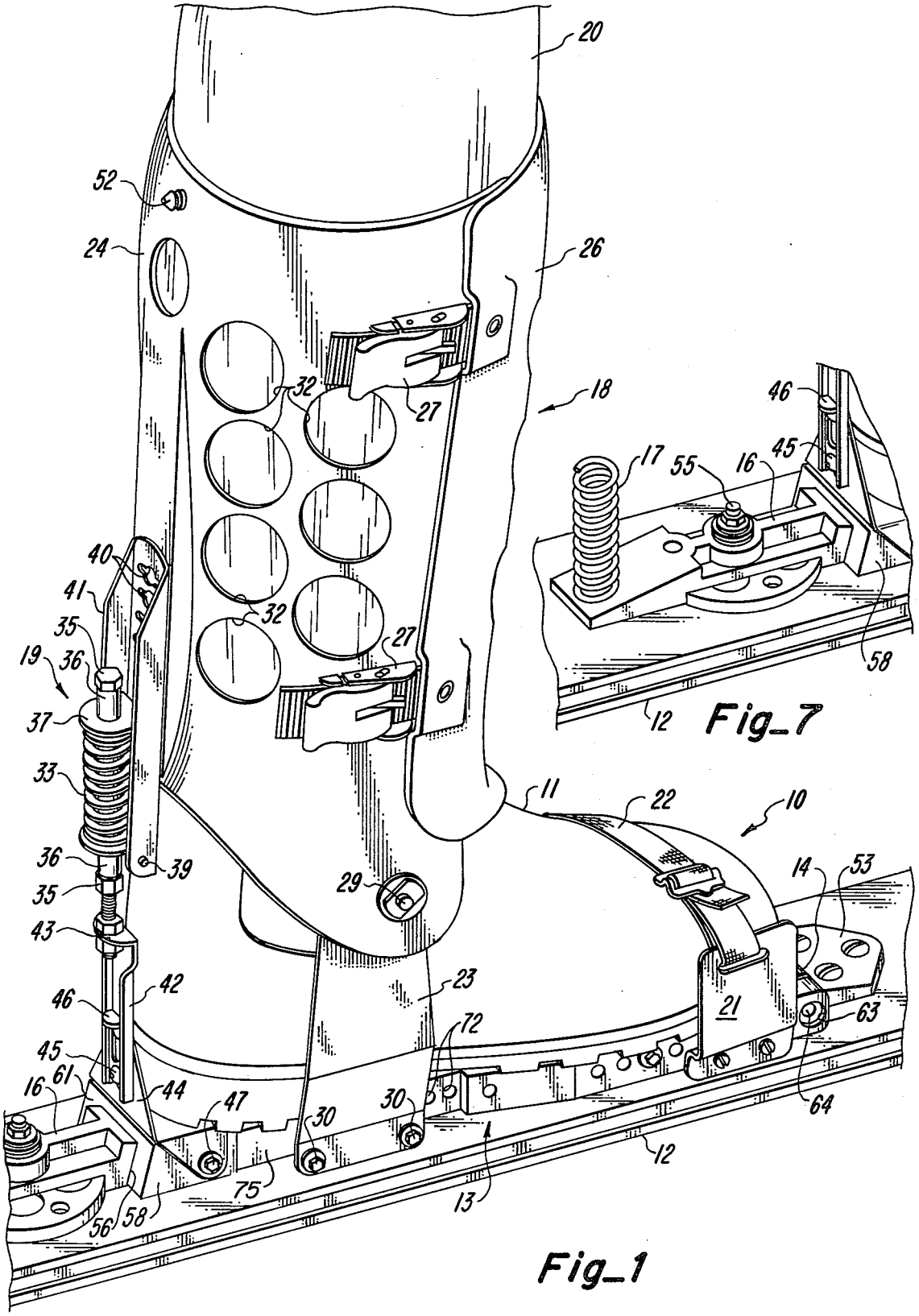
FIG. 1 is a perspective view of a skier's leg and footwear fixed to the snow ski binding of the present invention as mounted on a fragmented portion of a ski.
Figures 2, 3:
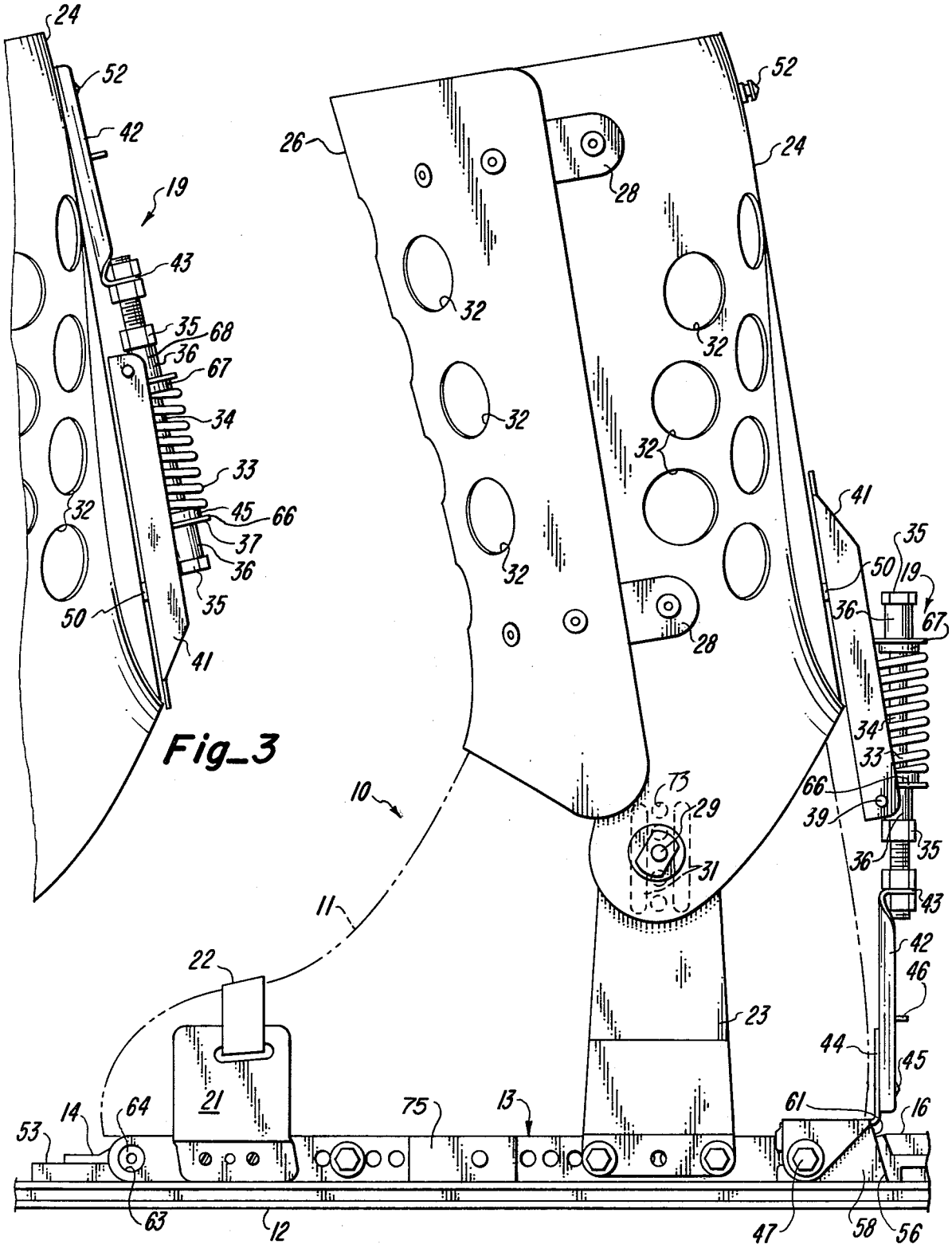
FIG. 2 is a side elevational view of the snow ski binding shown in FIG. 1.
FIG. 3 is a fragmentary side elevational view of a leg cast of the snow ski binding and a strut of the binding shown in a stored position.

A snow ski binding 10 of the present invention, shown in FIGS. 1 and 2, is of a type which may be selectively and interchangeably used for either downhill skiing or cross-country skiing. Unlike such ski bindings previously known, a skier may use footwear such as hiking boots 11, of a conventional type, without relying on rigid ski boots of the type associated with downhill skiing.

Use of conventional footwear 11 is made possible by the unique manner in which a skier's leg 20 and foot are secured to a snow ski 12. A boot plate 13 supports the footwear 11 and is releasably secured to the ski 12 at the toe and heel by a toe piece 14 and a heel piece 16 respectively. The leg 20 of the skier is held in a wraparound fashion by a leg cast 18 extending from just below the knee to the area of the ankle of the skier. Near the ankle, the leg cast is pivotally connected at 29 to a pair of braces 23 secured to both sides of the boot plate. The toe of the footwear extends between a pair of brackets 21 securely mounted to each side of the boot plate. An adjustable strap 22 interconnects the brackets 21 and holds the top of the toe of the footwear downward against the boot plate.

At the rear of the leg cast 18 a generally elongated strut 19 extends downward from a rotatable connection at 50 on the leg cast 18 to connect to the boot plate 13 at 45, preventing the leg 20 from pivoting about the pivotal connection between the leg cast and the pair of braces 23. In downhill skiing, it is desirable to firmly or rigidly couple forces from the lower leg to the ski. Previously, rigid boots have been widely used for this purpose. In the snow ski binding 10 of the present invention the leg cast 18 performs a similar function by positively transferring leg movement to the boot plate 13. The braces 23 and brackets 21 and strap 22 also aid in coupling foot movement from the footwear 11 to the boot plate 13. Forward and backward movement of the leg is coupled to the boot plate by the relatively rigid strut 19 which connects the rear of the leg cast to the rear of the boot plate.

Cross-country skiing requires a more flowing or gliding movement, in which the heel lifts away from the surface of the ski 12. The snow ski binding 10 of the present invention is, in part, convertible to cross-country skiing by providing a pivotal connection between the toe piece 14 and the boot plate 13 near the toe of the footwear 11. The toe of the footwear continues to be held against the boot plate by the strap 22. The heel piece 16 can then be selectively disengaged from the boot plate 13 thus permitting the heel of the boot plate 13 to use from the surface of the ski while the entire boot plate 13 pivots about the toe piece 14. Additional technique advantages are gained by disconnecting the strut 19 from the boot plate 13 and either rotating it to a stored position against the leg cast 18 (FIG. 3) or removing it completely from the ski binding 10 (not shown). Once the strut 19 is disconnected, the leg 20 of the skier can move forward or pivot at the skier's ankle while the footwear 11 remains in contact with the boot plate because of the leg cast. The pivotal movement of the leg about the ankle provided by releasing the strut 19 permits, in combination with the release of the heel of the footwear from the ski, accomplishment of cross-country skiing technique.

The leg cast 18 includes a rear, generally semi-cylindrical portion 24 and a front, generally semi-cylindrical portion 26 pivotally connected to each other along one side, preferably the inner side, of the leg cast by flexible straps 28 (FIG. 2). The leg cast 18 is closed by pivoting the front portion 26 to the rear portion 24 and closing variable tension latches 27 to a sufficient degree that the leg cast 18 firmly grasps the leg 20. The tension latches are of a ratchet type having a tongue riveted to the front portion 26. The tongue is received through a ratchet portion of the latch 27 mounted on the rear portion 24. As shown in FIG. 1, a plurality of latches 27 may be utilized to close the front portion 26 to the rear portion 24 at the side, preferably the outer side, of the leg cast 18 opposite the side where the flexible straps 28 pivotally connect the front portion to the rear portion. Holes 32 (FIGS. 1 and 3) in the leg cast 18 reduce the overall weight of the leg cast and allow ventilation and air circulation to reach the skier's leg.

The front portion 26 of the leg cast 18 is pivotally connected to the rear portion 24 by the flexible straps 28 for pivoting movement about an axis substantially perpendicular to the ski 12. Thus, by closing latches 27 along the side opposite the flexible straps 28, the continuous leg cast is seen to wrap completely around the lower leg 20 of a skier between the knee and ankle, in generally conformable shape thereto.

The rear portion 24 of the leg cast 18 overlaps the ankle of a skier's leg 20. At the ankle, the leg cast is pivotally connected to the boot plate 13 through a rivet 29 joining the leg cast to the brace 23 interconnecting the leg cast to the boot plate 13. A rivet 29 is disposed on either side of the leg cast 18 to provide the pivotal connection between the leg cast and the brace.

Figure 4:
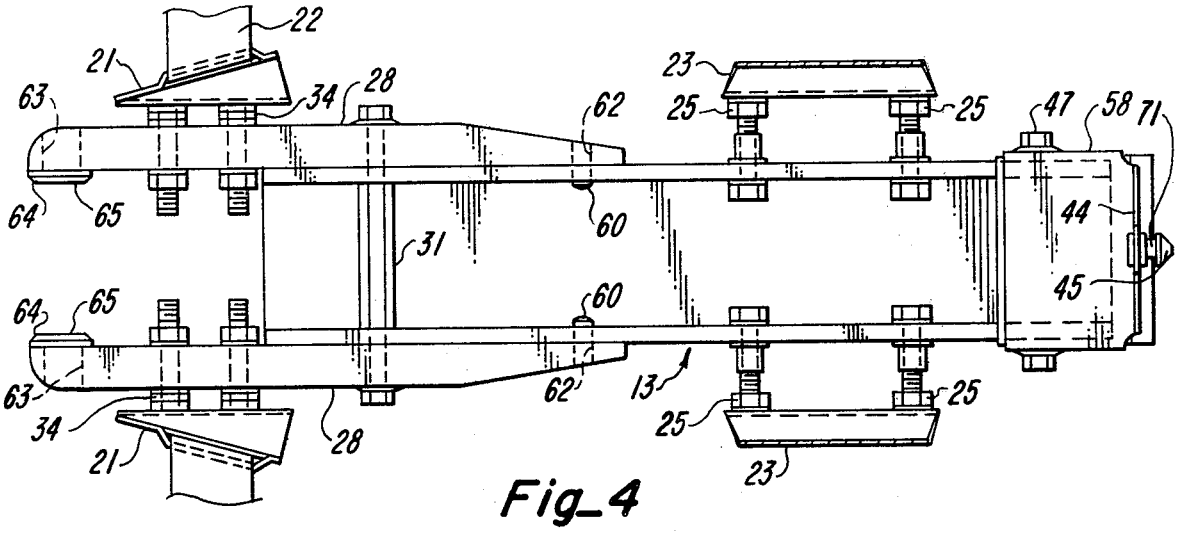
FIG. 4 is a top plan view of the boot plate portion of the snow ski binding shown in FIG. 1.

The brace 23 is fixed to the boot plate 13 through bolts 30. The bolts can adjust to varying widths of footwear 11 through nuts 25 threaded onto the bolts 30 which position the brace 23 relative to the boot plate, as best seen in FIG. 4.

Vertical adjustment for the height characteristics of the lower leg on a particular skier is achieved by variably positioning the rivets 29 on either side of the skier's leg 20 at or near the ankle of the skier. This is accomplished by a combination of slots 31 and holes 73 formed in the brace 23 (FIG. 2). Each brace, on either side of the leg 20, has a plurality of vertically aligned holes formed at approximately the midpoint of the width of the brace 23 at the approximate height of the ankle of the skier. On either side of these vertically disposed holes are slots 31 parallel to the aligned holes. In vertically adjusting the height of the leg cast, the rivet on one side of the leg cast passes through the vertically aligned holes to pivotally connect the leg cast and brace. The rivet 29 on the other side of the leg cast is secured through one of the slots 31. Preferably, the inside rivet 29 is fixed through a hole while the outside rivet fits through a slot. Once the rivet is fixed through a hole in the brace, the entire leg cast cannot slip relative to the brace 23. Any minor height adjustments can be readily made by adjusting the other rivet passing through the slot 31.

Once the leg cast 18 is tightly shut around the skier's leg, the leg cast can be used to transmit forces applied by a skier through the leg cast, the braces 23 and finally the boot plate 13 to the ski 12. In lateral turns, the braces 23 effectively transmit the forces exerted by a skier to the ski 12. The pivotal connection at 29 is in fact a selective pivotal connection, depending on whether or not the strut 19 is in place. If the strut 19 is in place, small relative pivoting moments both in a clockwise and counterclockwise direction about the rivet 29 are permitted. If the strut 19 is not interconnecting the leg cast to the boot plate, a much greater degree of pivotal movement, as is necessary for cross-country skiing, is permitted between the leg of a skier and the ski.

Figure 5:
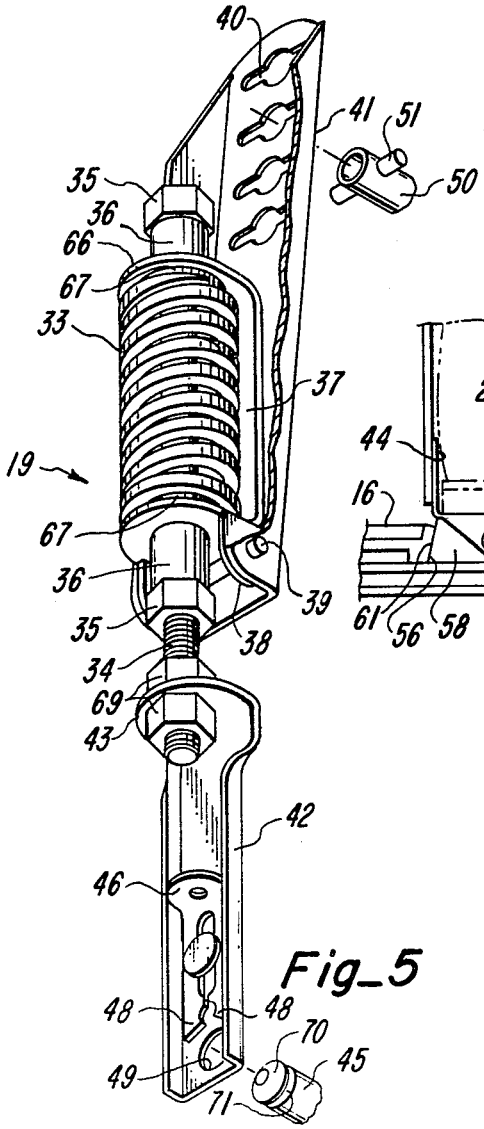
FIG. 5 is a perspective view of the strut connecting to a boot plate catch on the boot plate of the snow ski binding, with a portion of the strut broken away.

The strut 19, best seen in FIG. 5, includes a leg cast connector 41 for providing selective connection to the leg cast 18, a threaded rod-like body 34 extending coaxially with a spring or shock absorber 33, both in generally parallel relationship to the leg cast connector 41. A retainer 37 carries the rod and spring and is pivotally connected near the bottommost extension thereof to the leg cast connector. A heel connector 42 is connected to the rod 34 at the bottommost extension thereof and is selectively connectable to the boot plate 13. A pin 39 spans the width of the leg cast connector near the bottommost extension of the leg cast connector 41, when the strut 19 is in the position shown in FIG. 1. The pin 39 pivotally connects to depending ears 38 of the retainer 37, best seen in FIG. 5. Through the pivotal connection at 39, the strut can articulate through many different acute angles between the heel connector 42 and the leg cast connector 41.

The leg cast connector 41 is of U-shaped cross section having at evenly spaced intervals along its length, horizontally keyed holes 40, as shown in FIG. 1. The keyed holes are spaced apart so that the overall length of the strut 19 can be varied depending on the height of a particular skier.

The leg cast connector 41 of the strut 19 is selectively connectable to the rear portion 24 of the leg cast 18 through the keyed holes 40 and a stud 50 fixed to the rear portion 24 of the leg cast 18. A pin 51, tilted with respect to horizontal, passes diametrically through the stud 50. The keyed holes 40 of the leg cast connector fit over the tilted pin 51. Alignment of the leg cast connector and the entire strut to a vertical position relative to the ski 12 connects the leg cast connector and strut to the leg cast by forming an interference lock between the keyed holes and the tilted pin.

The retainer 37 includes a generally longitudinal flat portion, substantially parallel to the leg cast connector and upwardly turned flanged ends 66, normal to the flat portion, having holes therethrough. Hollow T-shaped cross sectional washers 36 each having a larger diameter end 67 and a smaller diameter end 68, best seen in FIG. 3, are positioned through the holes of the flanged ends 66 of the retainer 37. The smaller diameter ends of the washers 36 fit slidingly through the holes in the flanged ends of the retainer 37. The larger diameter ends of the washers 36 seat against the ends of the spring 33. The spring is thus positioned between the flanged ends 66 of the retainer. The rod 34 passes through the entire assembly which assembly is placed in a fixed position by tightening end nuts 35 threaded onto the rod against the washers 36.

The rod-like body 34 extends past the bottommost end nut 35 to threadably receive a pair of nuts 69 on either side of an turned flanged end 43 of the heel connector 42, as shown in FIG. 5. The heel connector 42 is of generally U-shaped cross section and extends the remaining distance between the rod 34 and the boot plate 13. A latch 46 is slideable within the interior of the heel connector 42 to selectively engage a boot plate catch 45. The boot plate catch is mounted on the rear or heel end of the boot plate 13 by a bracket 44 mounted on the rear of the boot plate by a bolt 47 (FIG. 1). The boot plate catch 45 has a conical portion 70 held at a short distance away from the brace 44 by a cylindrical portion 71. The latch 46 has a pair of flexible metal arms 48 adapted to snap over either side of the cylindrical portion of the boot plate catch 45 once the catch protrudes through hole 49 formed in the bottommost end of the heel connector 42. The conical portion of the boot plate catch 45 prevents the heel connector 42 from sliding along the cylindrical portion and disengaging the heel connector from the boot plate. Release of the latch 46 from the boot plate catch 45 permits a user to raise the heel connector from the catch 45 and rotate the entire strut about the stud 50. The latch of the heel connector can be reengaged on leg cast catch 52 (FIG. 5), which is of virtually identical shape to boot plate catch 45. The leg cast catch is located near the top of the leg cast 18 so that the strut can be relatched in the position shown in FIG. 3. Alternatively, alignment of the tilted pin 51 of the stud 50 with the horizontally keyed holes 40 of the leg cast connector 41, after release of latch 46, permits removal of the entire strut 19 from the binding 10.

Several features of the strut 19 enhance the convertibility of the ski binding 10 between downhill and cross-country skiing. The fact that the pivotal connection between the leg cast connector 41 and the spring retainer 37 about pin 39 is at the bottom of spring 33 permits the spring to bias pivotal movement at rivet 29 of the leg cast 18. Movements of the leg of a skier 20 in a forward pivotal movement about the rivet 29, as well as rearward movements about rivet 29, cause the leg cast connector 41 to pull up or push down on the pin 39 and therefore the retainer 37 slides over the small diameter end 68 of one of the washers 36 which is biased against the spring, absorbing these slight movements and making for more comfortable skiing. Prior art devices utilized two separate springs with an interconnection between the binding and the strut occurring between the springs in order to impart a bias both to a forward and a rearward pivotal movement of the skier's leg 20.

Another feature of the strut 19, arising because of the pivotal connection at pin 39 between the retainer 37 and the leg cast connector 41, is automatic alignment of the strut by bending or deflecting from the linear at the pin connection at 39. As seen in FIG. 2, the leg cast 18 and leg 20 are in fact tilted slightly forward relative to a vertical line through the ski 12. In order that the strut 19 connect very near the rear of the footwear 11, the strut must make adjustment for the angle of the leg cast relative to vertical, which is done through the pivotal connection at pin 39. A change in angle of the strut is also desirable when the strut 19 is rotated to the stored position shown in FIG. 3.

Figure 8:
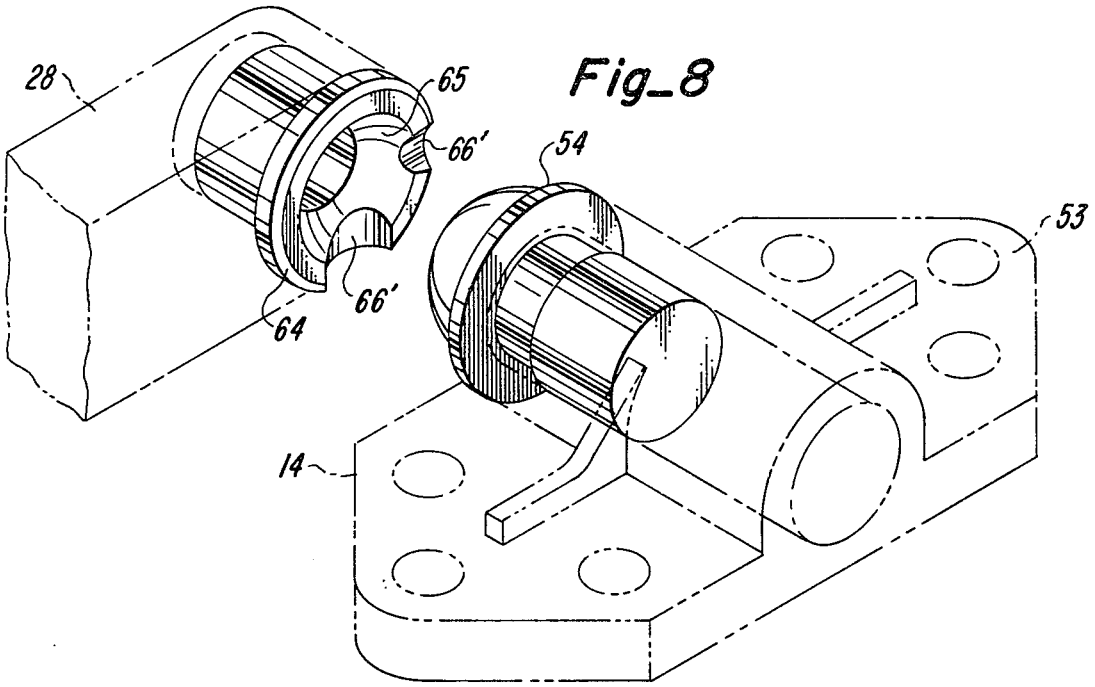
FIG. 8 is a perspective view of a connection between the boot plate and a toe piece of the snow ski binding.

The toe piece 14 of the ski binding 10 is attached to the ski 12 by screws or other suitable connection means, as seen in FIG. 1. The forwardmost portion of the toe piece 14 is a flat plate 53 adapted to contact the flat upper surface of the ski. The rearwardmost portion of the toe piece includes a pair of laterally projecting pins 54, (FIG. 8) raised slightly above the surface of the ski 12 and extending a relatively short distance away from the toe piece 14 as compared to the width of the ski 12. These laterally extending pins allow the toe piece 14 to pivotally connect to the boot plate 13 in a manner as described in detail in U.S. Pat. Nos. 4,002,354 and 4,157,191.

The heel piece 16 is rotatably mounted to the ski 12 by a pin 55 or similar mounting means. As seen in FIG. 1, for downhill skiing the forwardmost portion of the heel piece 16 has a forwardly beveled flat surface 56 adapted to matingly engage an end cap 58 fixed to the rear of boot plate 13 by bolt 47. To the rear of the heel piece 16 is mounted a resilient means 17 such as a coil spring extending upwardly from the ski 12. (FIG. 7) When in the position shown in FIG. 1, the heel piece 16 prevents the boot plate 13 from pivoting about the lateral pins 54 of the toe piece 14. Rotating the heel piece 16 180° releases the mating engagement and the boot plate 13 moves in an arc upward and forward about the pins of the toe piece 14 and places the resilient means 17 (FIG. 7) underneath the rear of the boot plate. This configuration is suited for assisting a cross-country skier in travelling uphill or any other way except downhill. Alternately, the heel piece 16 can be rotated 90° from the position shown in FIG. 1 and the boot plate 13 is still allowed to pivot but can return to a position flush with the upper surface of the ski 12. The heel piece 16 can also be rotated to free the boot plate 13, the boot plate pivoted, and then the heel piece returned to the position shown in FIG. 1 leaving the heel piece as a rigid support for the boot plate 13 to rest on as the boot plate returns to a position near the upper surface of the ski 12.

The boot plate 13 includes a main body member 75 of U-shaped transverse cross section opening upwardly from the ski 12 to support the footwear 11, as seen in FIG. 4. Adjustment holes (FIG. 1) along the upward sides of the main body member 75 receive fastening means to secure spring bars 28 to the main body member 75 as well as securing a barrel nut 31 spanning the interior width between the upward side portions of the main body member 75. The pair of spring bars 28 protrude forwardly a selected distance from the main body member 32 to fit over the laterally projecting pins 54 of the toe piece 14. The barrel nut 31 is secured to both spring bars through the main body member so that, depending on the distance between the barrel nut and the pins 54, the force required to deflect the spring bars, and thereby release the binding 10 from the ski 12, is either increased or decreased. The rear of each spring bar is fixed at a position relative to the main body member 32 by a pin 60 extending through a hole 62 in the spring bar member and a corresponding adjustment hole 72. The end cap 58 has a beveled surface 61 (FIG. 6) which is frictionally contacted by the corresponding surface 56 on the heel piece 16 as has been previously described.

The spring bars 28 in combination with the laterally extending pins 54 of the toe piece 14 secure the forward end of the boot plate 13 to the ski 12 as well as obtain vertical toe release or torsional release when the ski binding 10 is being used for downhill skiing. For this purpose each spring bar has at the forwardmost end an aperture 63 which receives a release socket 64, as best seen in FIG. 4. The inwardmost surface of each release socket 64 includes a concavely-shaped indented cam surface 65 which receives the pin 54 of the toe piece 14. A pair of grooves 66′ (FIG. 8) are formed in the cam surface 65 for initially connecting the pin to the sockets and for assisting with vertical or torsion release of the spring bars 28 from the toe piece 14. A more detailed description of the toe piece 14, heel piece 16 and boot plate 13 and their function can be found in U.S. Pat. Nos. 4,002,354 and 4,157,191, both issued to Paul C. Ramer, the inventor herein.

Figure 6:
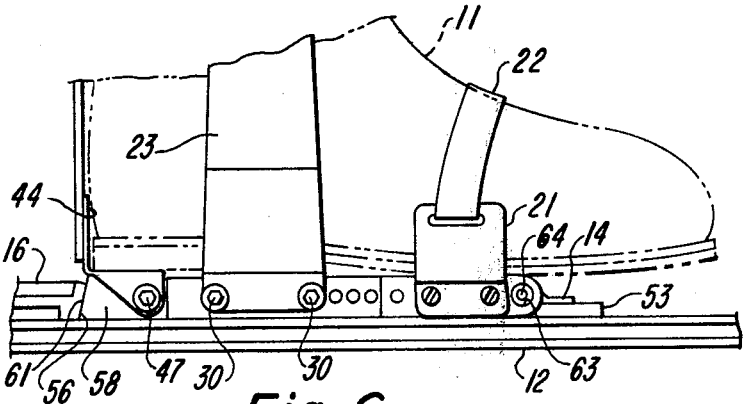
FIG. 6 is a fragmentary side elevational view of an alternative embodiment of a portion of the snow ski binding.

In an alternative embodiment, the axis about which the footwear 11 of a user pivots is near the ball of the boot (FIG. 6). The boot plate 13 is formed so as to be shorter than in the previous embodiment disclosed. The toe piece 14 and associated pin means 54 are moved so that they are positioned to establish the pivotal connection with the boot plate beneath the ball of the foot. In this manner the more natural action of pivoting about the ball of the foot is permitted, as is the technique most commonly used in cross-country skiing.

Although the present invention has been described with a certain degree of particularity, it is understood that the present disclosure has been made by way of example and that changes in detail to the structure may be made without departing from the spirit of the invention.

What I claim is:

1. A ski binding for releasably connecting a skier's leg and associated footwear to a ski comprising in combination:

a toe piece mounted on said ski including laterally extending pin means;

a boot plate releasably connected to said ski, said boot plate rotatably connected to said pin means, whereby rotation of the boot plate relative to the toe piece is provided about an axis transverse to said ski;

a heel piece mounted on said ski, said heel piece being releasably connectable to said boot plate to thereby selectively permit rotation of said boot plate relative to said toe piece;

a leg cast which surrounds and retains the lower leg of the skier, said leg cast being pivotally connected to said boot plate for selective movement about an axis substantially transverse to said ski; and strut means for adjusting the angular position of said leg cast relative to said boot plate, said strut means selectively connected to said leg cast, and said strut means being further selectively connectable to said boot plate.

2. The invention as defined in claim 1 wherein:

said laterally extending pins of said toe piece have cam surfaces on opposite ends thereof; and said boot plate is releasably connected to said pin means of said toe piece through a pair of semi-rigid spring bar means connected to either side of said boot plate extending longitudinally of said ski, said spring bar means having recesses on forward ends thereof for releasably receiving said ends of the pin means, said spring bar means flexing laterally outwardly upon release from said pin means, and selectively movable anchor means on said boot plate for anchoring the spring bar means to the boot plate at selected locations along the length of the spring member means.

3. The invention as defined in claim 1 wherein said laterally extending pin means are adjacent to the ski and are disposed underneath the ball of a skier's foot.

4. The invention as defined in claim 1 wherein said strut means includes:

shock absorption means intermediate said strut connection to said boot plate and said strut connection to the leg cast strut means.

5. The invention as defined in claim 1 wherein said strut includes:

a leg cast connector having a plurality of horizontally keyed holes along its length;

a stud with a pin tilted with respect to the horizontal, said pin passing diametrically through said stud, said stud and pin connected to the rear of said leg cast, and said stud and pin adapted to be received by the holes in said leg cast connector;

shock absorption means having a second pin located near the bottommost extension of said shock absorption means, said second pin pivotally connecting said shock absorption means to said leg cast connector; and a heel connector with one end thereof connected at substantially the bottommost extension of said shock absorption means, said heel connector selectively connected to the boot plate.

6. The invention as defined in claim 5 wherein said strut is selectively connected to said boot plate by a latch reciprocably received at the bottommost extension of said heel connector; and a boot plate catch fixed to said boot plate adapted to selectively engage said latch.

7. The invention as defined in claim 6 wherein a leg cast catch is mounted at the upper portion of said leg cast, whereby the latch can be disengaged from the boot plate catch and the strut rotated around the stud to a diametrically opposed position and the latch engaged by the leg cast catch.

8. The invention as defined in claim 5 wherein said shock absorption means is a spring coaxial with a rod, said spring and rod being disposed between upwardly turned ends of a retainer, said retainer further being pivotally connected to said leg cast connector.

9. The invention as defined in claim 8 further including:

a pair of hollow T-cross sectional washers slideable on said rod, a larger diameter end of each washer seated against said spring, a smaller diameter end of each washer passing through a hole in the flanged end of said retainer, said washers placed in a fixed position by a nut threaded onto said rod whereby said spring is in a fixed position.

10. The invention as defined in claim 1 wherein said leg cast is pivotal, relative to said boot plate, near the ankle of a skier's leg.

11. The invention as defined in claim 1 wherein vertical adjustment means are provided in the pivotal connection between the leg cast and the boot plate.

12. The invention as defined in claim 1 wherein said leg cast includes:

a rear portion generally conformable to the rear of the skier's leg, said rear portion pivotally connected to said boot plate;

a front portion generally conformable to the front of a skier's leg, said front portion flexibly connected to said rear portion along one side of said leg cast; and latching means to tightly connect said front portion to said rear portion, said latching means located along the other side of said leg cast.

13. The invention as defined in claim 12 wherein said rear portion and front portion have a plurality of holes therein.

14. A ski binding for releasably connecting a skier's leg and associated footwear to a ski comprising in combination:

a toe piece mounted on said ski including laterally extending pin means;

a boot plate releasably connected to said ski, said boot plate being rotatably connected to said pin means, whereby rotation of said boot plate relative to the toe piece is provided about an axis transverse to said ski;

a heel piece mounted on said ski;

said heel piece being releasably connectable to said boot plate to thereby selectively permit rotation of said boot plate relative to said toe piece;

a leg cast which surrounds and retains the lower leg of the skier; strut means interconnecting said leg cast and said boot plate and releasably connected to the leg cast and to the boot plate; and a pair of generally vertically extending braces fixedly connected to either side of said boot plate and pivotally connected to said leg cast at the ankle of the skier whereby said leg cast can pivot about a second axis transverse to said ski passing through the ankle of the skier.

15. The invention as defined in claim 14 wherein:

said laterally extending pins of said toe piece have cam surfaces on opposite ends thereof; and said boot plate is releasably connected to said pin means of said toe piece through a pair of semi-rigid spring bar means connected to either side of said boot plate extending longitudinally of said ski, said spring bar means having recesses on forward ends thereof for releasably receiving said ends of the pin means, said spring bar means flexing laterally outwardly upon release from said pin means, and selectively movable anchor means on said boot plate for anchoring the spring bar means to the boot plate at selected locations along the length of the spring member means.

16. The invention as defined in claim 14 wherein said laterally extending pin means are adjacent to the ski and are disposed underneath the ball of a skier's foot.

17. The invention as defined in claim 1 wherein said strut means includes:

shock absorption means intermediate said strut connection to said boot plate and said strut connection to the leg cast.

18. The invention as defined in claim 14 wherein said strut means further includes:

a leg cast connector selectively connected at one end to said leg cast;

elongated shock absorption means having a pin located near the longitudinal center of said shock absorption means, said pin pivotally connecting said shock absorption means to the other end of said leg cast connector;

a heel connector forming the lowermost end of said strut means, said heel connector being selectively connected to the boot plate.

19. The invention as devined in claim 18 wherein said strut is selectively connected to said boot plate by a latch reciprocably received at the lowermost end of said heel connector; and a boot plate catch fixed to said boot plate adapted to selectively engage said latch.

20. The invention as defined in claim 19 wherein a leg cast catch is mounted at the upper portion of said leg cast, whereby when said latch is disengaged from the boot plate catch and the strut is rotated a predetermined amount, it can be released from said leg cast catch.

* * * * *